US007152930B2

(12) United States Patent
Jertson

(10) Patent No.: US 7,152,930 B2
(45) Date of Patent: Dec. 26, 2006

(54) MOTORIZED FLOOR STRIPPER WITH ADJUSTABLE MOTION

(75) Inventor: Ronald I. Jertson, Covina, CA (US)

(73) Assignee: Roberts Consolidated Industries, Inc. A Q.E.P. Company, Boca Raton, FL (US)

( * ) Notice: Subject to any disclaimer, the term of this patent is extended or adjusted under 35 U.S.C. 154(b) by 0 days.

(21) Appl. No.: 10/899,737

(22) Filed: Jul. 27, 2004

(65) Prior Publication Data

US 2006/0022509 A1 Feb. 2, 2006

(51) Int. Cl.
*A47L 11/12* (2006.01)

(52) U.S. Cl. ..... 299/37.1; 30/170; 15/93.1

(58) Field of Classification Search ..... 299/36.1, 299/37.1, 37.2; 30/169, 170; 15/93.1
See application file for complete search history.

(56) References Cited

U.S. PATENT DOCUMENTS 935,911 A * 10/1909 Johnson et al. ..... 30/170
2,519,138 A 8/1950 Katz
4,009,908 A 3/1977 Alinder et al.
4,088,369 A 5/1978 Prater
4,162,809 A 7/1979 Anderson et al.
4,626,033 A 12/1986 Anderson
4,821,357 A 4/1989 Millette
4,963,224 A 10/1990 Anderson
5,702,161 A 12/1997 Finney et al.
5,713,637 A 2/1998 Worden et al.
5,772,284 A 6/1998 Lindsey et al.

FOREIGN PATENT DOCUMENTS

CA 1255856 6/1989

* cited by examiner

*Primary Examiner*—Sunil Singh
(74) *Attorney, Agent, or Firm*—Christie, Parker & Hale, LLP

(57) ABSTRACT

A motorized floor stripper for stripping a floor covering away from a floor surface. The floor stripper has wheels and a motor mounted to a frame. An operator uses handles on the frame to move the floor stripper across the floor. The motor is coupled to an eccentric driver, which may be an eccentric cam. The eccentric driver is coupled in turn to a driven member. The driven member is coupled to the frame at a coupling point, and a working element such as a blade is attached to the driven member opposite the eccentric driver. When the motor drives the eccentric driver, the driven member drives the working element in a motion that depends on the configuration of the eccentric driver, the driven member, and the coupling point. By adjusting the location of the coupling point relative to the frame, the operator may adjust the motion of the working element to achieve a motion particularly suitable for removing the floor covering that is being stripped away from the floor.

14 Claims, 4 Drawing Sheets

MOTORIZED FLOOR STRIPPER WITH ADJUSTABLE MOTION

BACKGROUND OF THE INVENTION

The invention relates generally to mechanical linkages by which a working element may be driven by a power source. More particularly, the invention provides a user-adjustable linkage for use in a electric motor-driven carpet stripper used to strip carpet and similar floor coverings from a floor.

Motor-driven carpet strippers of the general type in which the invention may find use are known in the art. FIG. 1 is a perspective view of this kind of carpet stripper. The carpet stripper 5 is built around a frame 7 with a working element in the form of an angled blade 10 at one end of the frame, and a pair of wheels 13 at the other. Handles 15 mounted on a shaft 17 attached to the wheel end of the frame allows an operator to steer the stripper, and an electrical motor 18 drives the blade through a linkage that will be described in more detail below. Power is supplied to the motor though a long electrical cord 20 connected to a switch 23 mounted near the handles. Finally, a weight 25 holds the blade down as it slides under a carpet 28 or a similar floor covering.

A variety of linkages have been used to connect the blade 10 to the driving motor 18. One such linkage is shown in FIG. 2, which depicts the underside of a representative prior art carpet stripper 5. This view shows the bottom of the stripper's frame 7. An eccentric cam 30 is fixed to the electric motor's driveshaft 33.

The eccentric cam drives a first end 35 of a driven member 32 in an orbital motion, thereby driving the blade 10 at the second end of the driven member. In this prior art embodiment, motion of the driven member is further constrained by a linkage arm 40, which is mounted to the frame and driven member at a pair of pivot points, frame pivot point 43 and driven member pivot point 45.

Motor-driven carpet strippers of the general type shown in FIGS. 1 and 2 have proved useful and have found considerable acceptance in the industry. It has been found, moreover, that different blade motions may be more useful for different floor coverings, such as different carpets, tile, vinyl floor coverings, etc., or that different blade motions may be preferable to different operators. A variety of linkages has been employed between the motor and the blade, each linkage being constructed to yield a somewhat different motion for the blade. These blade motions may be primarily (1) orbital, with the driven member and blade rotating about a more or less fixed pivot point; (2) reciprocal, with the blade being driven back and forth in a line parallel to the shaft of the handle; (3) transverse, with the primary motion of the blade being back and forth in a direction parallel to the axle between the wheels; or virtually any imaginable combination of the previous three motions.

Operators and flooring companies have thus been led to keep on hand a range of different strippers so that a desired one can be chosen as desired by a particular operator or as particularly appropriate for a given flooring. This is less than ideal, however, because it requires having more strippers on hand than would otherwise be required so that a desired one will be available for use. A need exists, therefore, for a means by which the motion of a particular stripper could be adjusted to suit the requirements of a given floor covering or to match the preferences of a particular operator. The present invention meets this need and provides other advantages that will be best appreciated by reference to the detailed description and figures that appear in this document.

SUMMARY OF THE INVENTION

The invention provides a motorized floor stripper that is adjustable by an operator to produce a range desired motions in a working element such as a blade that is driven to cut away or remove a floor covering from a floor surface. An eccentric driver coupled to a motion produces an input motion, which is applied to a driven member coupled to the eccentric driver. The driven member is coupled to the body of the stripper at an adjustable coupling point, and an output motion is produced in the working element that depends on the juxtaposition of the eccentric driver, the coupling point, and the working element. By adjusting the location of the coupling point, the output motion of the working element may be modified within a range of possible output motions. The operator may thus select an output motion that he regards as optimal for removing the particular floor covering that he is removing from the floor surface.

DESCRIPTION OF THE PREFERRED EMBODIMENTS

Figure 1:
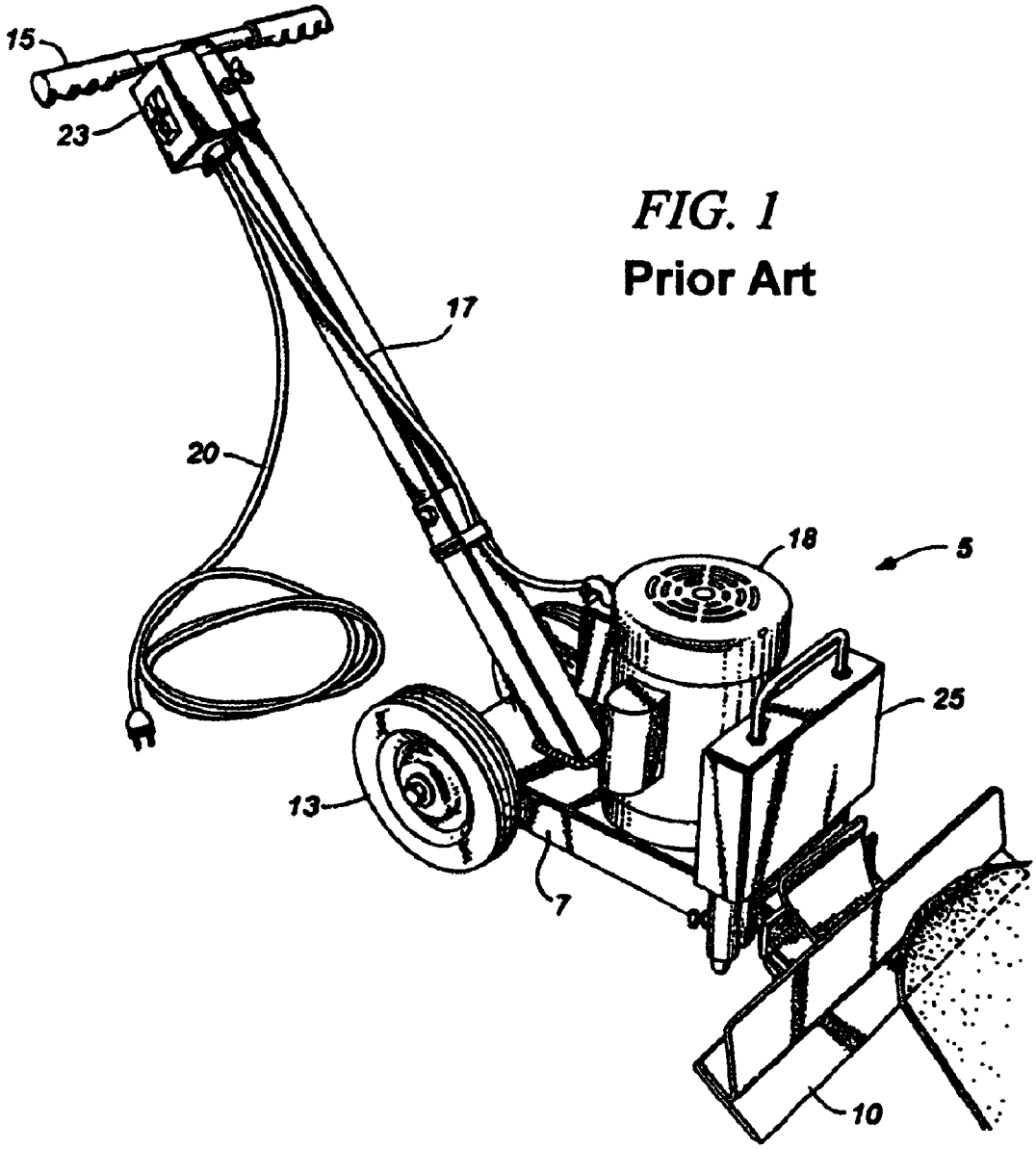
FIG. 1 Prior Art
FIG. 1 is a perspective view showing a known prior art motor-driven carpet stripper.
Figure 2:
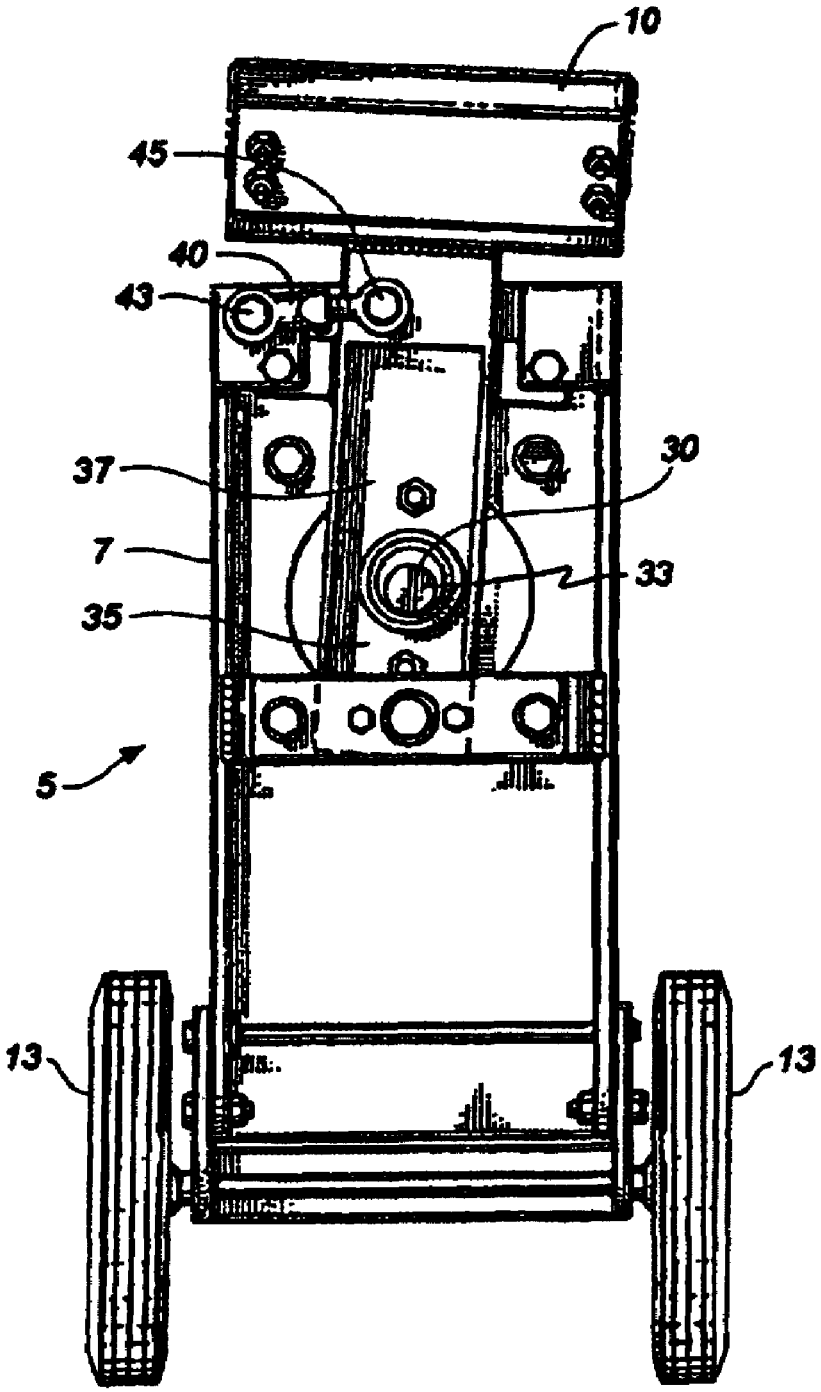
FIG. 2 Prior Art
FIG. 2 is a plan view showing the bottom of the prior art carpet stripper of FIG. 1.
Figure 3:
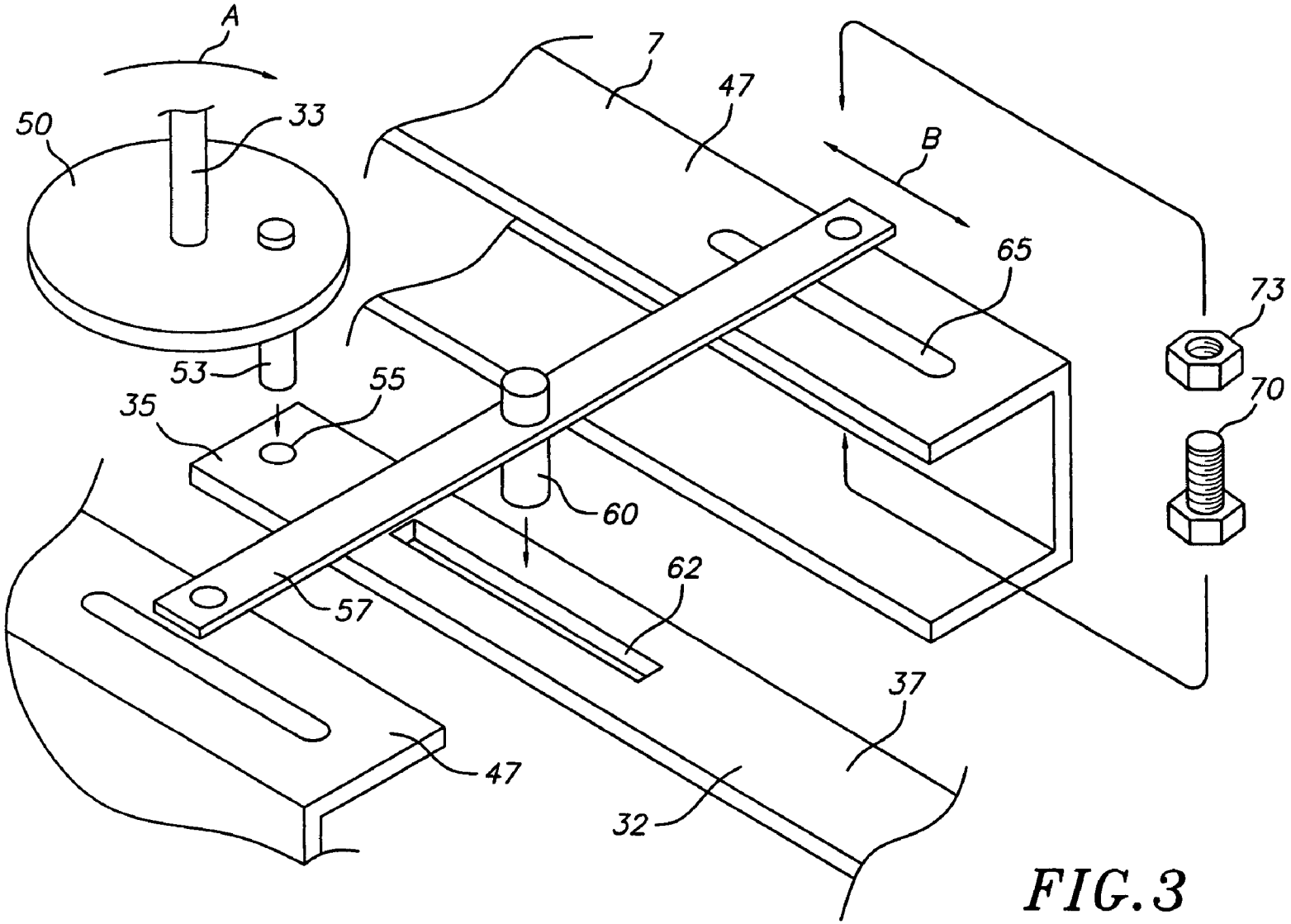
FIG. 3 illustrates parts a carpet stripper incorporating the adjustable linkage of the invention.

A novel mechanical linkage incorporating the invention is depicted, somewhat schematically, in FIG. 3. As shown in that illustration, the frame 7 of a new carpet stripper includes a pair of frame rails 47 on each side of the frame. In this embodiment, as in known embodiments, a driven member 32 is connected to an eccentric driver 50 at a first end 35. A working element, which will usually be a conventional cutting blade (not shown in FIG. 3, see FIGS. 1 and 2) is fixed to the driven member at a second end 37 opposite the eccentric driver.

The illustration of FIG. 3 is somewhat schematic and depicts the eccentric driver 50 as including an eccentric pin 53 offset from the driveshaft 33 of the motor. The eccentric pin fits into a receiving hole 55 in the first end 35 of the driven member 32. Thus, operation of the motor drives the first end of the driven member in an orbital motion as indicated by a first arrow A in FIG. 3.

The particular construction depicted in FIG. 3 is mainly for clarity of illustration. In practice, preferred embodiments will likely use the known eccentric cam construction for the eccentric driving member, in contrast to the eccentric pin shown in FIG. 3. Nevertheless, the general principal of operation is the same, and any of a variety of eccentric driving members may find use depending on the particular requirements of any given embodiment.

The embodiment of FIG. 3 also includes an adjustable pin bracket 57 mounted transversely between the frame rails 47. A central pin 60 is fixed to and carried by the pin bracket. The central pin fits into a central slot 62, cut lengthwise into the driven member 32.

The driven member is thus constrained to move about the coupling point established by the central pin when driven by the eccentric driver 50.

As will be described further below, changing the position of the pin bracket 57 along the length of the frame rails 47 changes the resulting motion of the blade when the motor is switched on. The pin bracket should thus be mounted to the frame rails with some suitable apparatus that will hold it securely in place but that will also allow an operator to move in conveniently as desired. The pin bracket may be mounted to the frame by any suitable means, including some sort of clamp or any suitable fastener. As an example, FIG. 3 illustrates, again somewhat schematically, that the pin bracket may be fastened to the frame rails by a bolt 70 and a nut 73 fitted through a frame rail slot 65 cut through each of the frame rails. By loosening the nuts, an operator may conveniently adjust the position of the pin bracket as desired along the length of the frame rails as illustrated by the lengthwise arrow B.

The pin bracket 57 depicted in FIG. 3 is quite narrow and thin. This is mainly for ease of visibility in the semi-schematic illustration. In fact, this part must be of considerable strength to constrain adequately the motion of the driven member 32. One of skill in the mechanical arts will have no undue difficulty in designing machine parts of appropriate size and strength for any given application.

Figures 4A, 4B, 4C:
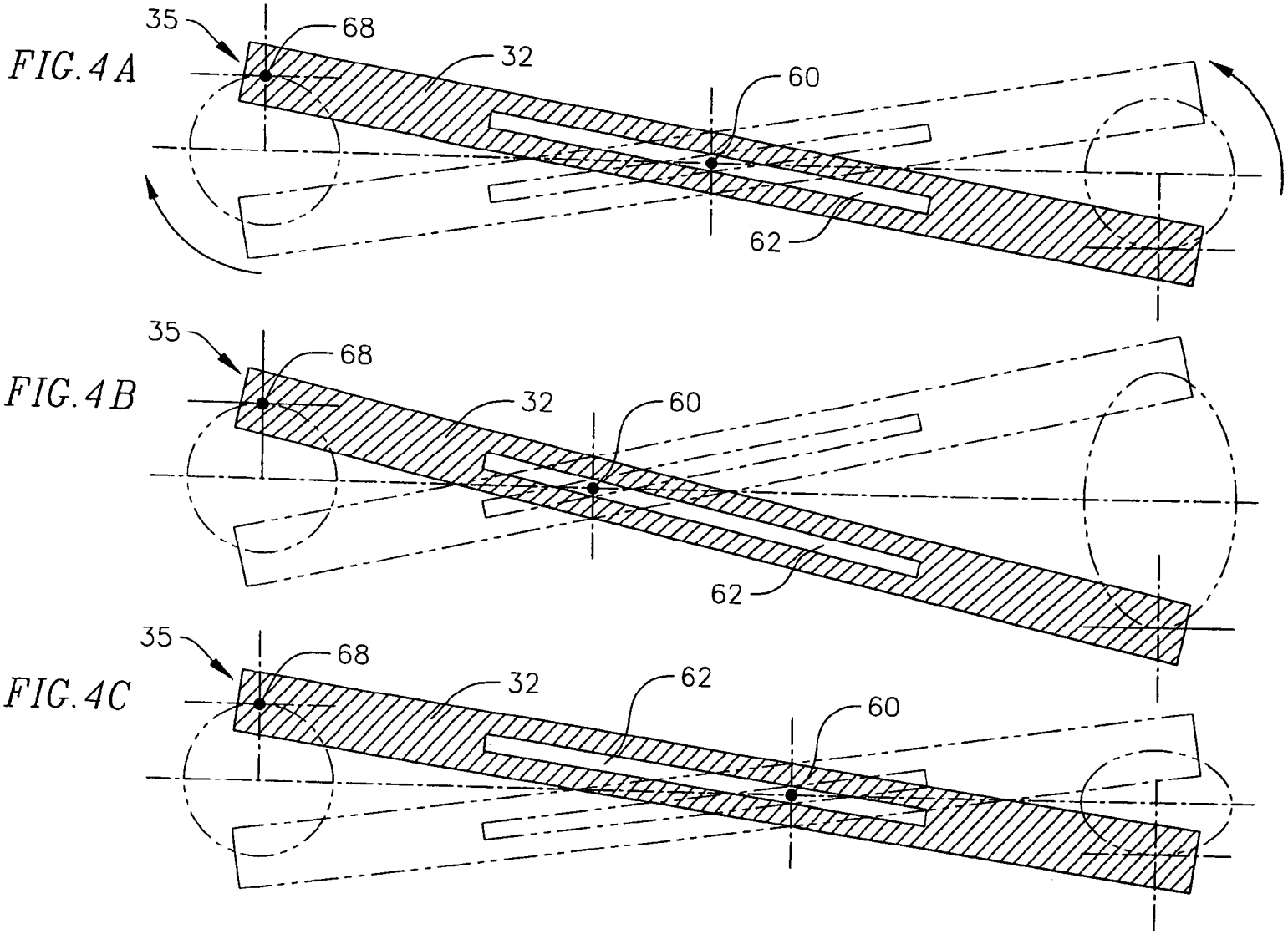
FIGS. 4A-4C are graphic illustrations showing the effect of adjusting the linkage of FIG. 3 on the output motion of the working blade of the carpet stripper.
Figure 2:
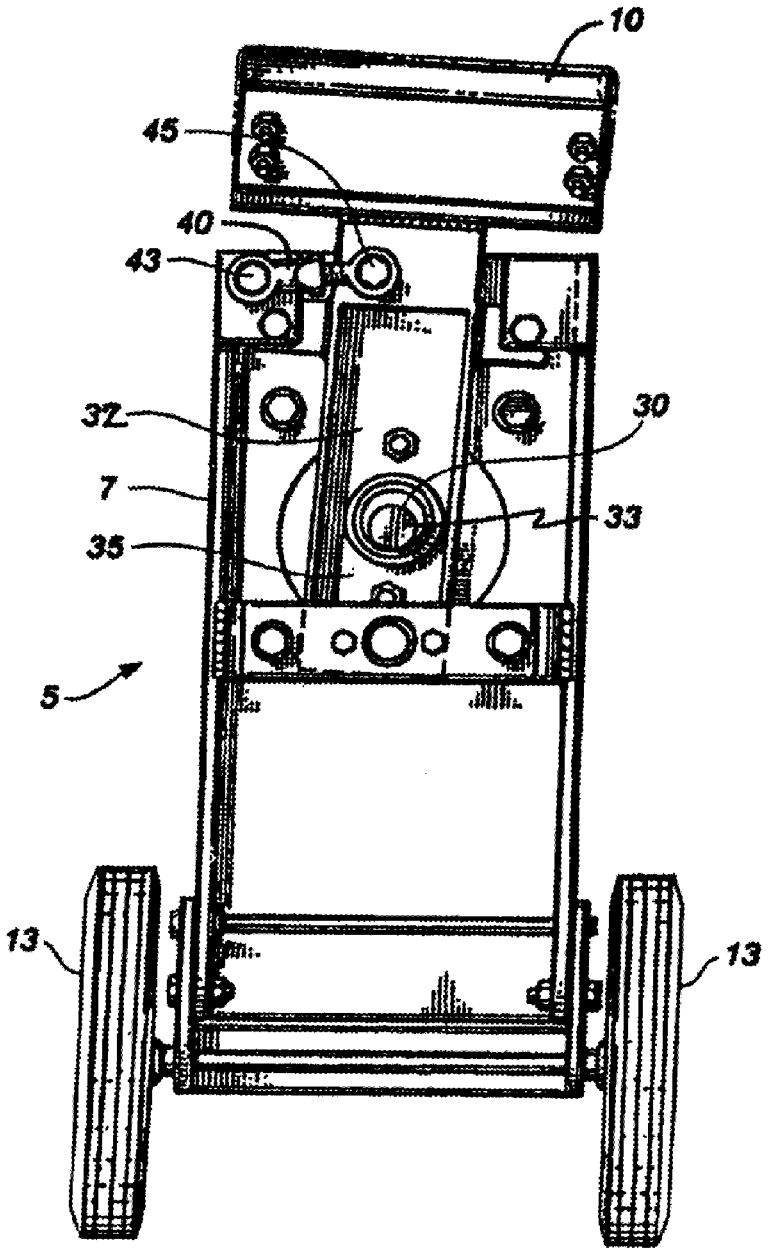
FIG. 2 PRIOR ART

The adjustability of the blade's motion can be readily appreciated with reference to FIGS. 4A–4C. Referring first to FIG. 4A, the driven member 32 is attached to the eccentric driving member (not shown) at an attachment point 68. In FIG. 4A, the pin bracket is positioned so the central pin 60 is positioned midway within the central slot 62 of the driven member. Thus a circular motion of the eccentric driving member at the attachment point yields an approximately equivalent motion (in the opposite direction) of the blade at the second end 37 of the driven member.

FIG. 4B illustrates a situation in which the user has moved the pin bracket back towards the wheel side of the frame so that the central pin 60 has been located closer to the first end 35 of the driven member 32 and the attachment point 68 on the eccentric driving member. This shortens considerably the lever arm between the attachment point and the central pin. The resulting motion of the blade therefore includes a much larger transverse component perpendicular to the long axis of the frame.

The converse is shown in FIG. 4C. In that illustration, the pin bracket has been moved forward, thereby moving the central pin 60 forward in the central slot 62 of the driven member 32. As the figure indicates, the resulting motion has a much smaller transverse component and is therefore more purely reciprocal along the long axis of the frame.

Although a preferred embodiment of the invention has been described herein, modifications and additions will no doubt occur to those of skill in the art. For example, a wide variety of driving members may find use, along with any number of alternative, user-adjustable means for constraining motion of the driven member. Moreover, although the preferred embodiment of the invention is described herein in connection with a motor-driven carpet stripper, it is likely that the invention could also find use in other situations in which an adjustable linkage might be desired between a working element at one end of the linkage and a source of motive power at the other. The scope of the invention should therefore be determined by reference to the appended claims, along with the full scope of equivalents to which those claims are legally entitled.

What is claimed is:

1. A stripper usable by an operator to remove a flooring material from a floor surface, the stripper comprising:

an eccentric driver;

a driven member having first and second ends, the first end operably connected to the eccentric driver;

a structure defining a coupling point;

a working element operably connected to the second end of the driven member, wherein the second end reciprocates and moves transversely relative to the coupling point, wherein the eccentric driver is operable to drive the first end of the driven member in a non-linear input motion, wherein the driven member is coupled to the coupling point at a location between its first and second ends, wherein the location of the coupling between the coupling point and the driven member is adjustable by a user of the stripper, wherein the structure defining the coupling point comprises a pin coupled to a slot on the driven member, and wherein the pin is fixed to a pin bracket, and wherein the location of the pin bracket is adjustable by the floor stripper's operator:

a frame including at least two frame rails disposed apart from one another; and an apparatus for adjusting the location of the pin bracket along the frame and securing the pin bracket to the frame rails.

2. The stripper of claim 1, wherein the eccentric driver comprises an eccentric cam mounted to a drive shaft of a motor.

3. The stripper of claim 1, wherein the apparatus for adjusting and securing the pin bracket to the frame rails includes:

at least two bolts passing through slots in the frame rails; and at least two nuts for securing the bolts in position relative to the frame rails.

4. A motorized floor stripper usable by an operator to remove a flooring material, the stripper comprising:

a frame;

at least two wheels attached to the frame;

a handle attached to the frame and operable by the operator to move the stripper on the wheels;

a motor secured to the frame;

an eccentric driver configured to be driven by the motor;

a driven member coupled to the eccentric driver at a first location;

a working element attached to the driven member at a second location; and structure secured to the frame defining a coupling point between the driven member and the frame at a location between the first location and the second location; wherein the location of the coupling point relative to the frame is adjustable by the operator of the stripper, and wherein the second location reciprocates and moves transversely relative to the coupling point, wherein the structure defining the coupling point comprises a pin coupled to a slot on the driven member, wherein the pin is fixed to a pin bracket, and wherein the location of the pin bracket is adjustable by the floor stripper's operator; and an apparatus for adjusting and securing the pin bracket along the frame.

5. The floor stripper of claim 4, wherein the eccentric driver comprises an eccentric cam mounted to a driveshaft of the motor.

6. The stripper of claim 4, wherein the apparatus for adjusting and securing the pin bracket with respect to the frame includes:

at least one bolt passing through at least one slot in the structure of the frame; and at least one nut for securing the bolt in position relative to the frame.

7. A method for using a motorized floor stripper to remove a flooring material from a floor surface, the method comprising;

operating a motor coupled to a frame of the stripper and to an eccentric driver to produce an input motion;

releasably fixing a coupling point on the frame at a first position relative to the frame;

driving a driven member with the eccentric driver about the coupling point to produce a first output motion in a working member secured to the driven member;

moving the position of the coupling point to a second position relative to the frame different from the first position;

releasably fixing the coupling point on the second position, wherein when in the first position the coupling point is releasably fixed at a first location on the frame and wherein when in the second position, the coupling point is releasably fixed at a second location on the frame different from the first location; and driving the driven member with the eccentric driver to produce a second output motion different from the first output motion.

8. A stripper usable by an operator to remove a flooring material from a floor surface, the stripper comprising:

an eccentric driver;

a driven member having first and second ends, the first end operably connected to the eccentric driver;

a structure defining a coupling point; and a working element operably connected to the second end of the driven member, wherein the second end reciprocates and moves transversely relative to the coupling point, wherein the eccentric driver is operable to drive the first end of the driven member in a non-linear input motion, wherein the driven member is coupled to the coupling point at a location between its first and second ends, wherein the location of the coupling between the coupling point and the driven member is adjustable by a user of the stripper; and a frame, wherein the eccentric driver and the driven member are coupled to the frame and wherein the structure defining the coupling point is fixable at different locations on the frame, and wherein the driven member pivots and reciprocates about the coupling point.

9. The stripper as recited in claim 8 wherein the coupling point location is releasably fixable on the frame.

10. A motorized floor stripper usable by an operator to remove a flooring material, the stripper comprising:

a frame at least two wheels attached to the frame;

a handle attached to the frame and operable by the operator to move the stripper on the wheels;

a motor secured to the frame;

an eccentric driver configured to be driven by the motor;

a driven member coupled to the eccentric driver at a first location;

a working element attached to the driven member at a second location; and structure secured to the frame defining a coupling point between the driven member and the frame at a location between the first location and the second location, wherein the location of the coupling point relative to the frame is adjustable by the operator of the stripper, wherein the second location reciprocates and moves transversely relative to the coupling point, and wherein the structure defining the coupling point location is fixable to different locations on the frame, and wherein the driven member pivots and reciprocates about the coupling point.

11. The stripper as recited in claim 10 wherein the coupling point location is releasably fixable on the frame.

12. A stripper for removing a flooring material from a floor surface, the stripper comprising:

a frame;

an eccentric driver coupled to the frame;

a coupling point releasably fixable at a plurality of locations on the frame;

a driven member being driven by the eccentric driver and coupled to the coupling point, wherein the driven member pivots and translates about the coupling point; and a working element coupled to the driven member.

13. The stripper of claim 12 wherein the coupling point is releasably fixed on the frame.

14. The stripper of claim 12 further comprising a motor for driving the eccentric driver.

* * * * *

UNITED STATES PATENT AND TRADEMARK OFFICE

CERTIFICATE OF CORRECTION

PATENT NO. : 7,152,930 B2
APPLICATION NO. : 10/899737
DATED : December 26, 2006
INVENTOR(S) : Jertson It is certified that error appears in the above-identified patent and that said Letters Patent is hereby corrected as shown below:

| | |
|---|---|
| Column 1, line 17 | Delete “allows”,<br>Insert --allow-- |
| Column 2, line 4 | After “a range”,<br>Insert --of-- |
| Column 2, line 26 | After “illustrates parts”,<br>Insert --of-- |
| Column 4, line 17, Claim 1 | Delete “operator:”,<br>Insert --operator;-- |
| Column 4, line 47, Claim 4 | Delete “location;”,<br>Insert --location,-- |
| Column 6, line 5, Claim 10 | After “a frame”,<br>Insert --;-- |

Signed and Sealed this

Thirteenth Day of November, 2007

JON W. DUDAS
*Director of the United States Patent and Trademark Office*

UNITED STATES PATENT AND TRADEMARK OFFICE

CERTIFICATE OF CORRECTION

PATENT NO. : 7,152,930 B2
APPLICATION NO. : 10/899737
DATED : December 26, 2006
INVENTOR(S) : Jertson It is certified that error appears in the above-identified patent and that said Letters Patent is hereby corrected as shown below:

In the Drawings

| | |
|---|---|
| FIG. 2, Sheet 2 of 4 | Delete Drawing Sheet 2 and substitute therefore the Drawing Sheet, consisting of Fig. 2, as shown on the attached page. |

Signed and Sealed this

First Day of April, 2008

JON W. DUDAS
*Director of the United States Patent and Trademark Office*